US005800876A

United States Patent [19]

Börner et al.

[11] Patent Number: 5,800,876

[45] Date of Patent: Sep. 1, 1998

[54] METHOD AND DEVICE FOR CONTROLLING THE OUTFLOW OF A FLUIDIZED SOLID FROM A CONTAINER

[75] Inventors: Gunter Börner, Mühlhausen; Johann Nienburg, Heidelberg; Jörg Sopka, Schwetzingen; Josef Wittmann, Hockenheim, all of Germany

[73] Assignee: ABB Research Ltd, Zurich, Switzerland

[21] Appl. No.: 804,129

[22] Filed: Feb. 20, 1997

[30] Foreign Application Priority Data

Feb. 20, 1996 [DE] Germany ..... 196 06 214.4

[51] Int. Cl.[6] ..... B05D 1/06; B05B 7/24; B05L 19/04

[52] U.S. Cl. ..... 427/459; 427/475; 427/185; 118/308; 118/309; 118/DIG. 5

[58] Field of Search ..... 427/182, 459, 427/475, 185; 118/308, 309, DIG. 5; 239/569, 586, 434, 704; 406/136–138, 144, 146

[56] References Cited

U.S. PATENT DOCUMENTS

| | | | |
|---|---|---|---|
| 4,500,560 | 2/1985 | Guffroy | 427/8 |
| 4,764,056 | 8/1988 | Zentgraf et al. | 406/68 |
| 5,558,713 | 9/1996 | Siegfried et al. | 118/308 |

FOREIGN PATENT DOCUMENTS

| | | |
|---|---|---|
| 32 44 742 A1 | 6/1984 | Germany . |
| 385 134 B | 2/1988 | Germany . |
| 40 10 914 C1 | 7/1991 | Germany . |
| 44 14 513 A1 | 11/1994 | Germany . |
| 43 25 044 A1 | 2/1995 | Germany . |
| 44 36 919 A1 | 4/1996 | Germany . |
| 94/13405 | 6/1994 | WIPO . |

*Primary Examiner*—Shrive Beck
*Assistant Examiner*—Fred J. Parker
*Attorney, Agent, or Firm*—Herbert L. Lerner; Laurence A. Greenberg

[57] ABSTRACT

A method and a device for controlling the outflow of fluid powder from a container can be used for controlling the expulsion of powder out of a powder-spraying apparatus for electrostatic coating. The disadvantages of a mechanical closing device are avoided by introducing closing air into an extraction pipe for extracting fluidized powder out of a container. The closing air is introduced through a pipe which opens into an orifice in the casing of the extraction pipe. The mass flow of fluidized powder can be controlled by an appropriate setting of a pressure in the extraction pipe in relation to the pressure in the fluid bed, that is to say by the introduction of closing air at an appropriate pressure.

5 Claims, 2 Drawing Sheets

METHOD AND DEVICE FOR CONTROLLING THE OUTFLOW OF A FLUIDIZED SOLID FROM A CONTAINER

BACKGROUND OF THE INVENTION

Field of the Invention

The invention relates to a method for controlling the outflow of a fluidized solid from a container, which includes discharging the fluidized solid out of a fluid bed in the container with an extraction pipe leading out of the container. The invention also relates to a device for controlling the outflow of a fluidized solid from a container, including an extraction pipe for discharging the fluidized solid.

The method and the device can be used, in general, for the closing or partial or complete opening of an outflow orifice of a container for a fluidized solid, wherein an increased pressure or ambient air pressure may prevail in the container.

The method and the device are particularly suitable for use in powder-spraying appliances for electrostatic coating. Such a powder-spraying appliance is described by way of example in German Published, Non-Prosecuted Patent Application 195 37 089 A1, corresponding to U.S. patent application Ser. No. 08/726,815, filed Oct. 7, 1995. The structure of that powder-spraying appliance is explained in more detail below with reference to FIG. 1. With regard to the subject of that invention, it is essential that the powder-spraying appliance has a mechanical closing system for the powder outflow.

Such a mechanical closing system is subject to wear. Moreover, when spraying commences, in each case a small quantity of non-fluidized powder flows out first, since fluidization does not take place in the extraction pipe. Powder deposits may occur in the extraction pipe.

SUMMARY OF THE INVENTION

It is accordingly an object of the invention to provide a method and a device for controlling the outflow of a fluidized solid form a container, which overcome the hereinafore-mentioned disadvantages of the heretofore-known methods and devices of this general type.

With the foregoing and other objects in view there is provided, in accordance with the invention, a method for controlling the outflow of a fluidized solid from a container, which comprises discharging a fluidized solid out of a fluid bed located in a container through an extraction pipe leading from the container; and introducing closing air at an orifice in a casing of the extraction pipe for controlling a mass flow of the fluidized solid from zero to a maximum value with the closing air, depending on air pressure set by the closing air in the extraction pipe.

In accordance with another mode of the invention, there is provided a method which comprises controlling the expulsion of powder out of a powder-spraying appliance for electrostatic coating.

With the objects of the invention in view there is also provided a device for controlling the outflow of a fluidized solid from a container, comprising an extraction pipe for discharging a fluidized solid from a container, the extraction pipe having a casing with an orifice formed therein; and an air pipe opening into the orifice for introducing closing air into the extraction pipe to control a mass flow of fluidized solid in the extraction pipe.

In accordance with a concomitant feature of the invention, the container is part of a powder-spraying appliance for electrostatic coating, and fluidized powder can be extracted from a middle region of a fluid bed in the container by the extraction pipe.

The method and the device ensure that by introducing closing air into the extraction pipe, the powder is forced out of the pipe back into the container and the expulsion of powder is thereby stopped. Consequently, during each closing operation, cleaning of the extraction pipe takes place simultaneously. No solids are deposited, no non-fluidized solid particles flow out when spraying commences, and mechanical wear of moving parts is avoided. A nozzle conventionally disposed at the outlet is cleaned through the use of the closing air whenever spraying stops. The mass flow of fluidized solid can be controlled in a simple way by changing the stream of closing air. The expulsion of solids can also be set at intermediate values between zero and a maximum value by setting appropriate pressure conditions.

Other features which are considered as characteristic for the invention are set forth in the appended claims.

Although the invention is illustrated and described herein as embodied in a method and a device for controlling the outflow of a fluidized solid from a container, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
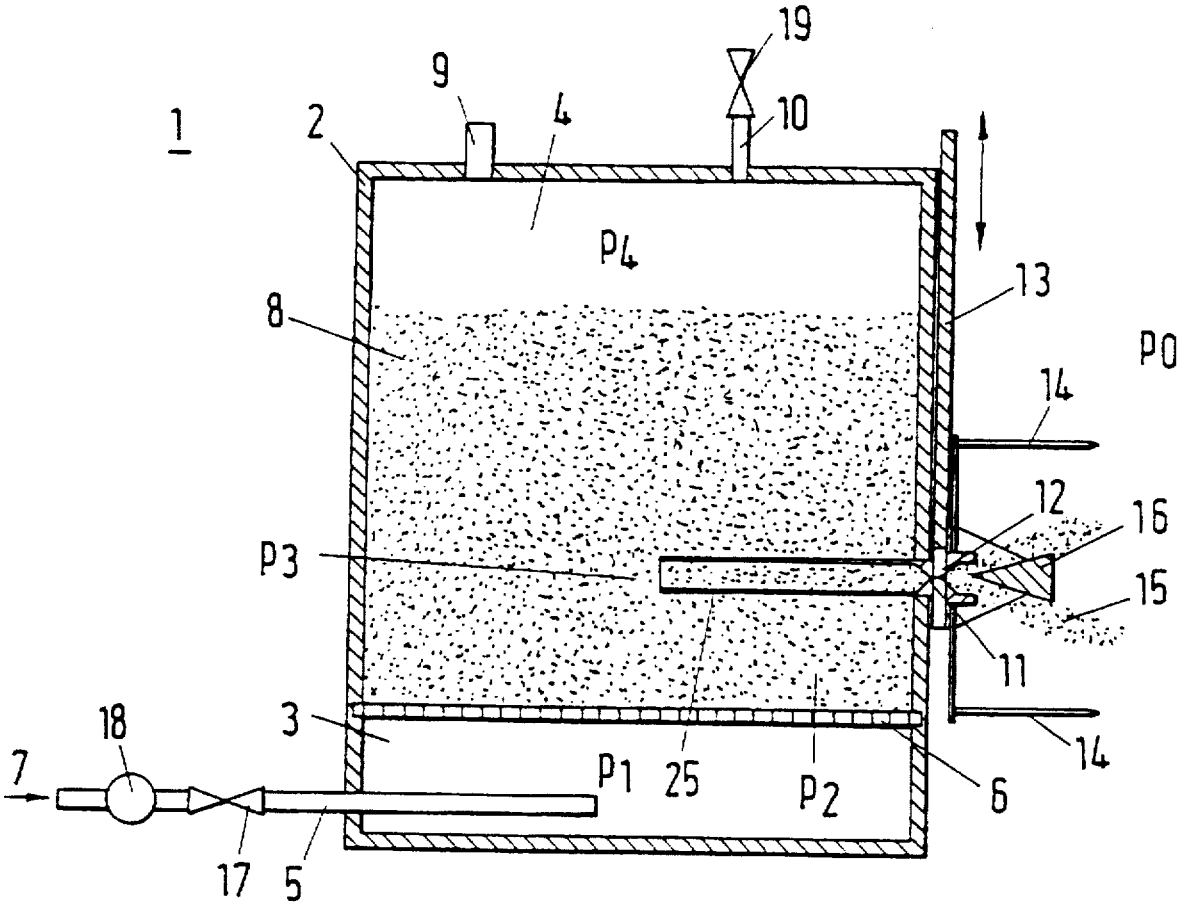
PRIOR ART Fig. 1
FIG. 1 is a basic diagrammatic, vertical-sectional view of a powder-spraying appliance with a mechanical closing device at a powder outflow.

Referring now to the figures of the drawings in detail and first, particularly, to FIG. 1 thereof, there is seen a powder-spraying appliance 1 which is already described in German Published, Non-Prosecuted Patent Application 195 37 089 A1, corresponding to U.S. patent application Ser. No. 08/726,815, filed Oct. 7, 1995 and which essentially includes a closed container 2 with a first chamber 3 and a second chamber 4. A compressed-air supply conduit 5 opens into the first chamber 3. Compressed air 7 passes through the supply conduit 5, the first chamber 3 and a frit 6 into the second chamber 4. Powder 8, which can be introduced through a powder supply orifice 9, is located in the second chamber 4.

The fluidizing air 7, which is guided through the frit 6 into the powder 8 and fluidizes the latter, can flow out again above the fluidized powder bed 8 through an air outflow orifice 10 at the container 2.

The fluidized powder 8 is extracted from the region of the fluid bed through a pipe 25 and is discharged through a nozzle 11 which is disposed laterally on the container 2 and which can be closed through the use of a mechanical closing device 13.

Needles which are connected to a non-illustrated high-voltage source and which cause outflowing powder particles to be charged, are disposed in a powder outflow region 12 as corona electrodes 14.

The shape of an outflowing powder cloud 15 can be determined by the nozzle 11 and an additional baffle body 16. The shape and placement of the electrodes 14 can be matched thereto.

The air supply can be influenced through the use of a controllable air inflow valve 17 and the air supply rate can be measured through the use of a flowmeter 18. The outflow orifice 10 for fluidizing air is closed off by a controllable outflow valve 19, with the result that a specific flow resistance can be set.

An air pressure $p_1$ in the first chamber 3 and an air pressure $p_4$ above the powder bed 8 can be regulated with the valves 17 and 19 through the use of a non-illustrated control and regulating device. In this case, the pressures $p_1$ and $p_4$ are measured through the use of suitable pressure sensors. The ambient air pressure is designated by reference symbol $p_0$. The air pressure above the frit 6 and therefore directly below the fluidized powder bed is designated by reference symbol $p_2$. A pressure drop $p_1-p_2$ is dependent on the selected frit 6 and must be taken into account in dimensioning.

The pressure within the container 2 in the fluid bed at a location level with the powder extraction is designated by reference symbol $p_3$ and can be set by regulating the pressures $p_1$ and $p_4$.

The quantity of outflowing powder and the velocity of the particles during outflow are determined by a differential pressure $\Delta p=p_3-p_0$, by the structure of the nozzle 11, that is to say by its flow resistance, by the parameters of the powder and by the fluidization state.

Since fluidization irregularities caused on the walls of the chamber, for example by bubbles, cannot be avoided, the powder is tapped from inside the chamber 4 through the pipe 25 which is attached to the nozzle 11. This ensures that the expulsion of powder is highly uniform.

Figure 2:
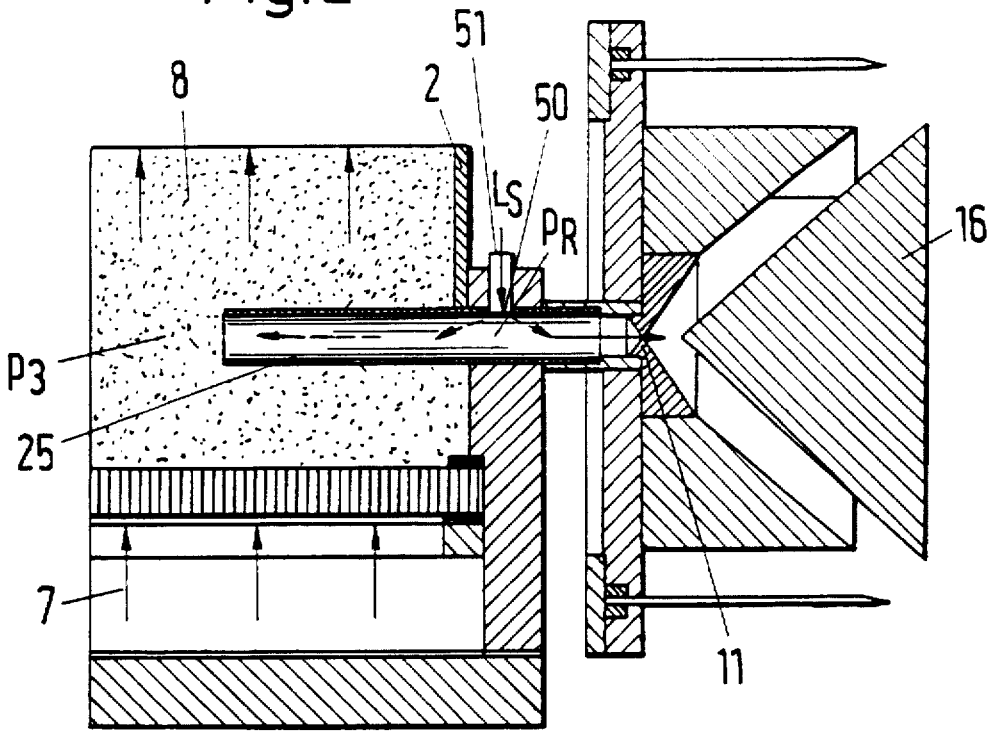
FIG. 2 is a basic diagrammatic, vertical-sectional view of a closing system operating by the introduction of air into an extraction pipe, wherein the closed state is shown.
Figure 3:
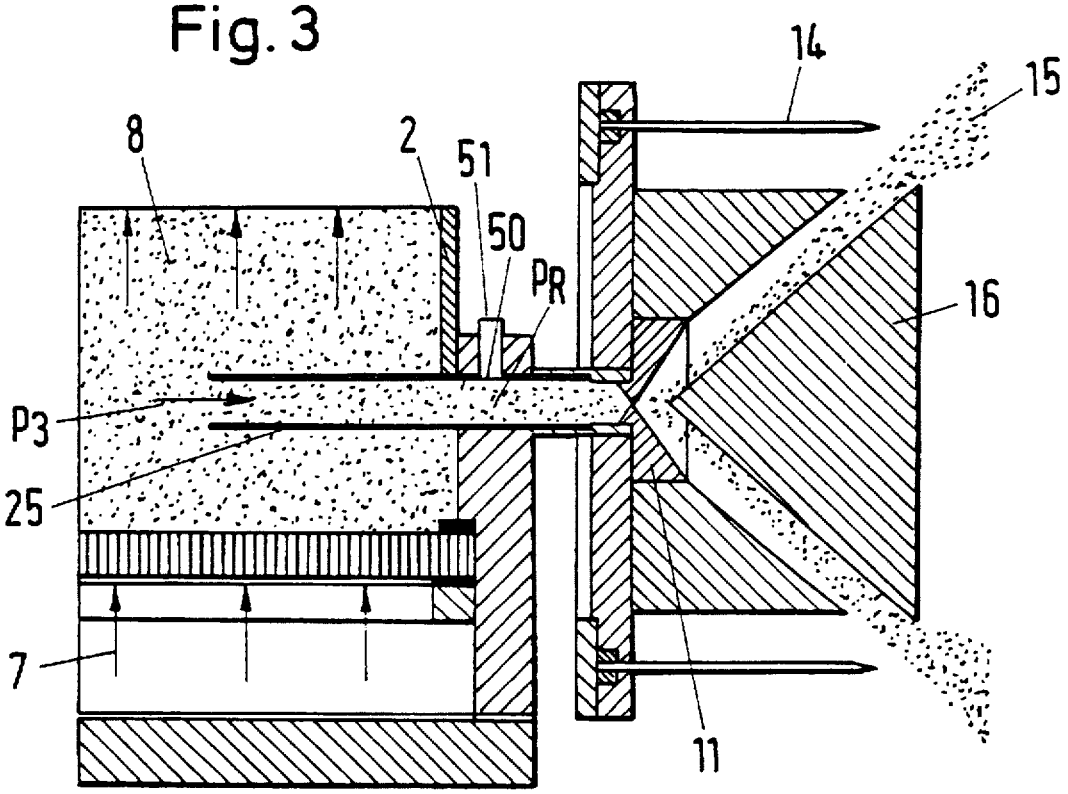
FIG. 3 is a view similar to FIG. 2 of the closing system shown therein, wherein the opened state is shown.

FIGS. 2 and 3 each show a basic representation of the structure according to the invention of a closing system for the outflow of fluidized powder. The system, which is capable of replacing the mechanical closing system shown in FIG. 1, is shown in FIG. 2 in a closed state and in FIG. 3 in an opened state. Reference symbols corresponding to those of FIG. 1 relate to components which are identical in each case.

FIG. 2 shows a section of the container 2, with the extraction pipe 25 for the fluidized powder 8. At a suitable point, a casing of the extraction pipe 25 has an orifice 50, into which an air pipe 51 opens. Closing air $L_s$ can be introduced into the air pipe 51. The method for controlling the outflow of fluid powder and consequently the mode of operation of the device shown in FIGS. 2 and 3 is explained below.

A closing air pressure $p_R$ is established in the air pipe 51, depending on the quantity of the closing air $L_s$ being introduced and on further parameters, such as the diameters of the extraction pipe 25, of the air pipe 51 and of the nozzle 11, the ambient air pressure $p_0$ and the fluid bed pressure $p_3$.

When the closing air pressure $p_R$ in the extraction pipe 25 is higher than the pressure $p_3$ in the container 2, an outflow of powder is prevented. In other words, in the event of a pressure ratio of $p_R/p_3>1$, the fluid powder 8 is forced back into the container 2. When the closing air pressure $p_R$ in the extraction pipe 25 is lower than the pressure $p_3$ in the container 2, that is to say in the case of a ratio $p_R/p_3<1$, fluidized powder flows out.

A numerical example may further illustrate what air pressures are required for closing. In the case of an extraction pipe diameter of 8 mm, an air pipe diameter of 2 mm and a nozzle diameter of 0.8 mm, with a container pressure $p_3$ of 2 bar (corresponding to 1 bar overpressure), a closing air pressure $p_R$ of at least 2.1 bar is required in order to stop the expulsion of powder completely.

If the nozzle diameter is 1.0 mm, under conditions that are otherwise identical to those mentioned above, a closing air pressure $p_R$ of at least 2.4 bar is required in order to stop the expulsion of powder completely.

In the closed state, some closing pressure, partially flowing through the pipe 25 into the container 2 and partially flowing out through the nozzle 11, is constantly consumed. In instances of use with relatively short intermissions between powder-spraying operations, this consumption of compressed air is of virtually no significance.

FIG. 2 shows a state in which a closing air pressure $p_R$ that is higher than the fluid bed pressure $p_3$ is set in the extraction pipe 25 by the appropriate introduction of closing air $L_s$. No outflow of powder occurs. The closing air $L_s$ flows partially into the container 2 and partially out through the nozzle 11.

FIG. 3 shows a state in which the supply of closing air $L_s$ is cut off completely and an expulsion of powder can thereby take place.

We claim:

1. A method for controlling the outflow of a fluidized solid from a container, which comprises:

providing a container for receiving a fluid bed of a fluidized solid, and an extraction pipe having a first end extending into the container for extracting the fluidized solid and a second end for discharging the fluidized solid;

providing a positive air pressure to the fluid bed for discharging the fluidized solid out of the fluid bed through the extraction pipe leading from the container to a nozzle; and controlling the discharge of the fluidized solid by introducing closing air transversely to a flow direction of the fluidized solid at an orifice in a casing of the extraction pipe at a pressure range of greater than the positive air pressure to a pressure of zero so that countering the positive air pressure and controlling a mass flow of the fluidized solid is correspondingly controlled from zero to a maximum mass flow with the closing air.

2. A device for controlling the outflow of a fluidized solid from a container, comprising:

a container for receiving a fluid bed of a fluidized solid, and an extraction pipe having a first end extending into said container for extracting the fluidized solid and a second end for discharging the fluidized solid;

said extraction pipe having a casing with an orifice formed therein; and an air pipe opening into said orifice for introducing closing air transversely to a flow direction of the fluidized solid into said extraction pipe to control a mass flow of fluidized solid in said extraction pipe.

3. A method for controlling the outflow of a fluidized solid from a powder-spraying appliance for electrostatic coating, which comprises:

providing a positive air pressure to a fluid bed for discharging a fluidized solid out of the fluid bed located in a container of a powder-spraying appliance through an extraction pipe leading from the container for electrostatic coating to a nozzle; and controlling the discharge of the fluidized solid by introducing closing air transversely to a flow direction of the fluidized solid at an orifice in a casing of the extraction pipe at a pressure range of greater than the positive air pressure to a pressure of zero so that countering the positive air pressure and controlling a mass flow of the fluidized solid is correspondingly controlled from zero to a maximum mass flow with the closing air.

4. A device for controlling the outflow of a fluidized solid from a powder-spraying appliance for electrostatic coating, comprising:

a container for receiving a solid forming a fluid bed in said container, said container having a middle region;

an extraction pipe having a first end for extracting the fluidized solid from said middle region of said container and a second end connected to a nozzle for discharging the fluidized solid, said extraction pipe having a casing with an orifice formed therein; and an air pipe opening into said orifice for introducing closing air transversely to a flow direction of the fluidized solid into said extraction pipe to control a mass flow of fluidized solid in said extraction pipe.

5. The device according to claim 4, wherein said second end of said extraction pipe is a discharge end and includes electrodes disposed at said discharge end for charging the fluidized solid material exiting said extraction pipe.

* * * * *